US009695675B2

(12) United States Patent
Hall

(10) Patent No.: US 9,695,675 B2
(45) Date of Patent: Jul. 4, 2017

(54) HIGH-RATE INJECTION SCREEN ASSEMBLY WITH CHECKABLE PORTS

(71) Applicant: Weatherford/Lamb, Inc., Houston, TX (US)

(72) Inventor: Christopher A. Hall, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 245 days.

(21) Appl. No.: 14/585,397

(22) Filed: Dec. 30, 2014

(65) Prior Publication Data

US 2015/0192001 A1 Jul. 9, 2015

Related U.S. Application Data

(60) Provisional application No. 61/923,419, filed on Jan. 3, 2014.

(51) Int. Cl.

| | |
|---|---|
| ***E21B 43/08*** | (2006.01) |
| ***E21B 43/04*** | (2006.01) |
| ***E21B 34/10*** | (2006.01) |
| ***E21B 34/08*** | (2006.01) |
| ***E21B 43/26*** | (2006.01) |
| *E21B 34/00* | (2006.01) |

(52) U.S. Cl.
CPC ..... *E21B 43/086* (2013.01); *E21B 34/08* (2013.01); *E21B 34/10* (2013.01); *E21B 43/04* (2013.01); *E21B 43/08* (2013.01); *E21B 43/26* (2013.01); *E21B 2034/002* (2013.01)

(58) Field of Classification Search
CPC ..... E21B 34/10; E21B 43/08
See application file for complete search history.

(56) References Cited

U.S. PATENT DOCUMENTS 2,004,071 A 6/1935 Hannesschlager
3,009,519 A 11/1961 Brown
(Continued)

FOREIGN PATENT DOCUMENTS

EP 2631423 A1 8/2013
WO 92/10639 A1 6/1992
(Continued)

OTHER PUBLICATIONS

First Office Action in counterpart Canadian Appl. No. 2,876,278, dated Feb. 2, 2016; pp. 1-4.
(Continued)

*Primary Examiner* — Shane Bomar
(74) *Attorney, Agent, or Firm* — Blank Rome, LLP

(57) ABSTRACT

A screen assembly can be used for "gravel pack" or "frac pack" operations and can then withstand high rate injections. The disclosed screen assembly is able to withstand the flow of the packing operation by not allowing fluid passage from the annulus to inside the screen assembly. Then, the screen assembly can be opened and facilitate high rate injection for the life of the well. To achieve this, the disclosed screen assembly does not allow slurry flow to enter the screen assembly during the packing operation. Then, after the packing is completed, the screen assembly provides enough open flow area so that a high injection rate with solid content can be introduced into the annulus without eroding the screen.

30 Claims, 9 Drawing Sheets

(56) References Cited

U.S. PATENT DOCUMENTS

| | | | | |
|---|---|---|---|---|
| 3,515,210 | A * | 6/1970 | Perkins | E21B 43/082 166/205 |
| 4,484,625 | A * | 11/1984 | Barbee, Jr. | E21B 37/08 166/185 |
| 5,127,474 | A * | 7/1992 | Schroeder, Jr. | E21B 43/045 166/151 |
| 5,249,626 | A | 10/1993 | Gibbins | |
| 6,354,378 | B1 * | 3/2002 | Patel | E21B 21/103 166/321 |
| 6,631,738 | B2 | 10/2003 | Jiang | |
| 6,886,634 | B2 | 5/2005 | Richards | |
| 6,899,176 | B2 | 5/2005 | Hailey, Jr. | |
| 7,240,739 | B2 | 7/2007 | Schoonderbeek et al. | |
| 8,448,659 | B2 * | 5/2013 | Veit | F16K 15/025 137/111 |
| 2006/0027377 | A1 | 2/2006 | Schoonderbeek et al. | |
| 2008/0035330 | A1 * | 2/2008 | Richards | E21B 43/08 166/228 |
| 2009/0065199 | A1 * | 3/2009 | Patel | E21B 23/03 166/250.01 |
| 2010/0051270 | A1 | 3/2010 | Dusterhoft et al. | |
| 2010/0175895 | A1 * | 7/2010 | Metcalfe | E21B 33/1277 166/382 |
| 2010/0252250 | A1 | 10/2010 | Fripp et al. | |
| 2011/0220347 | A1 | 9/2011 | Kayser | |
| 2012/0227839 | A1 * | 9/2012 | Veit | F16K 15/025 137/538 |
| 2013/0092394 | A1 * | 4/2013 | Holderman | E21B 43/108 166/373 |
| 2013/0255952 | A1 | 10/2013 | Hailey et al. | |
| 2015/0144330 | A1 * | 5/2015 | Noblett | E21B 33/1277 166/244.1 |

FOREIGN PATENT DOCUMENTS

| | | | |
|---|---|---|---|
| WO | 01/69036 | A1 | 9/2001 |
| WO | 2011/106579 | A2 | 9/2011 |

OTHER PUBLICATIONS

Patent Examination Report No. 1 in counterpart Australian Appl. No. 2015200005, dated Sep. 18, 2015; pp. 1-5.

Superior Energy Services Completion Services; Well Screens Brochure; www.superiorenergy.com; Dec. 12, 2013; pp. 1-19.

Schlumberger; FacsRite Sand Screen; www.slb.com/completions; Copyright 2008; pp. 1-2.

Schlumberger; LineSlot Sand Screen Data (Metric Units); www.slb.com/completions; Copyright 2007; pp. 1-2.

Schlumberger; ResInject Well Production Management System; www.slb.com/completions; Copyright 2007; pp. 1-2.

Schlumberger; Screens and ICDs—Largest Portfolio in the Industry; www.slb.com/transcend; Copyright 2013; pp. 1-8.

Search Report in counterpart EP Appl. No. 15150122, dated Apr. 15, 2016, 7-pgs.

* cited by examiner

HIGH-RATE INJECTION SCREEN ASSEMBLY WITH CHECKABLE PORTS

CROSS-REFERENCE TO RELATED APPLICATIONS

This application claims the benefit of U.S. Provisional Appl. 61/923,419, filed 3 Jan. 2014, which is incorporated herein by reference.

BACKGROUND OF THE DISCLOSURE

Reservoir completion systems installed in production, injection, and storage wells often incorporate screens positioned across the reservoir sections to prevent sand and other solids particles over a certain size from entering the reservoir completion. Conventional sand screen joints are typically assembled by wrapping a filter media around a perforated basepipe so fluids entering the sand screen from the wellbore must first pass through the filter media. Solid particles over a certain size will not pass through the filter media and will be prevented from entering the reservoir completion.

For example, a reservoir completion system 10 in FIG. 1 has completion screen joints 20 deployed on a completion string 14 in a borehole 12. Typically, these screen joints 20 are used for vertical, horizontal, or deviated boreholes passing in an unconsolidated formation, and packers 16 or other isolation elements can be used between the various joints 20 to isolate various zones 30A-30C of the formation. During production, fluid produced from the borehole 12 directs through the screen joints 20 and up the completion string 14 to the surface rig 18. The screen joints 20 keep out fines and other particulates in the produced fluid. In this way, the screen joints 20 can prevent the production of reservoir solids and in turn mitigate erosion damage to both well and surface components and can prevent other problems associated with fines and particulate present in the produced fluid.

In addition to open hole, the screen joints 20 can also be used in cased holes. Additionally, the screen joints 20 can be used for gravel pack operations in which gravel (e.g., sand) is disposed in the annulus of the borehole around the screen joint 20 to support the unconsolidated formation of the open borehole 12.

Screen joints having selectable sleeves, inflow control devices, valves, and the like have been designed in the past. As with other screen joints, these types of screen joints are used for filtering the flow of production fluid into the screen joints and to prevent flow of fluid out of the screen joints to the borehole.

In contrast to the screen joints of the prior art, there is a need for a screen assembly that can be used for "frac pack" operations and can then withstand high rate injections without flowback.

SUMMARY OF THE PRESENT DISCLOSURE

A screen assembly disclosed herein can be used for "gravel pack" or "frac pack" operations and can then withstand high rate injections. The disclosed screen assembly is able to withstand the flow of the packing operation by not allowing fluid passage from the annulus to inside the screen assembly. Then, the disclosed screen assembly can be opened and facilitate high rate injection for the life of the well. To achieve this, the disclosed screen assembly does not allow slurry flow to enter the screen assembly during the pack operation. Then, after the pack is completed, the screen assembly provides enough open flow area so that a high injection rate with solid content can be introduced into the annulus without eroding the screen.

In one embodiment disclosed herein, an apparatus is used for controlling fluid flow in a borehole. Method are also disclosed herein for controlling the fluid flow in the borehole. The apparatus includes a basepipe, at least one first outflow valve, and a first filter. The basepipe has an interior and defines at least one first orifice. The interior conveying the fluid flow, and the at least one first orifice communicates the interior with the borehole.

The at least one first outflow valve is disposed at the at least one first orifice. During operations, the at least one first outflow valve permits communication of the fluid flow in an outflow direction from the interior to the borehole and prevents communication of the fluid flow in an inflow direction from the borehole into the interior. For its part, the first filter is disposed on the basepipe adjacent the at least one first outflow valve. During operations, the first filter filters the fluid flow communicated between the interior and the borehole.

The at least one first outflow valve can include a ball movable between engaged and disengaged conditions relative to a portion of the at least one first orifice, which may or may not have an insert affixed therein. The first filter disposed on the basepipe external to the at least one orifice can then hold the ball adjacent the at least one first orifice.

For instance, the first filter can comprise a plurality of rings stacked adjacent one another on the exterior of the basepipe. To facilitate assembly, the rings can have alignment features aligning the adjacent ones of the rings with one another. To hold the check ball, however, at least some of the rings define a pocket that can capturing the ball of the at least one first inflow valve.

Overall, during gravel pack, frac pack, and production operations, the first filter filters the fluid flow communicated in the inflow direction from the borehole to the interior and prevents particulate from passing therethrough. During fluid loss operations, however, the first filter can bridge off with particulate in the fluid flow of weighted fluid communicated in the outflow direction from the interior to the borehole. Alternatively, a second filter can be disposed adjacent the at least one first orifice to bridge off with particulate in the fluid flow of weighted fluid communicated in the outflow direction from the interior to the borehole. Moreover, the at least one first outflow valve can bridge off with particulate in the fluid flow of weighted fluid communicated in the outflow direction from the interior to the borehole. For example, the particulate can collect around the ball of the outflow valve captured in the first orifice by the pocket of the first filter.

In a further embodiment disclosed herein, the first filter and the basepipe define a gap therebetween communicating the fluid flow, and a flow device in fluid communication with the gap communicates the gap with the interior of the basepipe. The flow device can have a flow restriction restricting the fluid flow from the gap into the interior of the basepipe. In addition or as an alternative, the flow device can have at least one inflow valve permitting communication of the fluid flow in the inflow direction from the gap to the interior and preventing communication of the fluid flow in the outflow direction from the interior to the gap.

As part of the apparatus, a cross-over assembly can be operable in a first operation communicating the fluid flow to the borehole. This first operation can be a frack pack or gravel pack operation, for example. In the first operation, the at least one first outflow valve prevents communication of returns of the fluid flow from the operation in the inflow direction into the interior, while the flow device permits the returns in the inflow direction into the interior.

The apparatus can have at least one second outflow valve disposed at at least one second orifice on the basepipe, such as at another isolated zone of the borehole. The at least one second outflow valve permits communication of the fluid flow in the outflow direction from the interior to the borehole and prevents communication of the fluid flow in the inflow direction from the borehole into the interior. In this situation, the cross-over assembly may prevent the returns in the interior from the flow device from communicating with the at least one second outflow valve by using a packer, seals, and the like. Alternatively, a sleeve disposed on the basepipe can be used to selectively prevent the returns in the interior from the flow device from communicating with the at least one second outflow valve.

As part of the apparatus, an injection assembly can be operable in a second operation to communicate the fluid flow into the interior of the basepipe. This second operation can be an injection or treatment operation, for example, typically performed in a borehole. In this situation, the at least one first outflow valve permits communication of the fluid flow from the second operation in the outflow direction from the interior to the borehole to achieve the injection or treatment desired.

The foregoing summary is not intended to summarize each potential embodiment or every aspect of the present disclosure.

DETAILED DESCRIPTION OF THE DISCLOSURE

As noted previously, there is a need for a screen assembly that can be used for "frac pack" operations and can then withstand high rate injections. Frac packing is an operation that combines fracturing a formation and gravel packing the annulus. Such a screen assembly as disclosed herein is able to withstand the flow of the frac pack operation by not allowing fluid passage from the annulus to inside the screen assembly. Then, the disclosed screen assembly can be opened and facilitate high rate injection for the life of the well. To achieve this, the disclosed screen assembly does not allow slurry flow to enter the screen assembly during the frac pack operation. Then, after the frac pack is completed, the screen assembly provides enough open flow area so that a high injection rate with solid content can be introduced into the annulus without eroding the screen.

Figure 1:
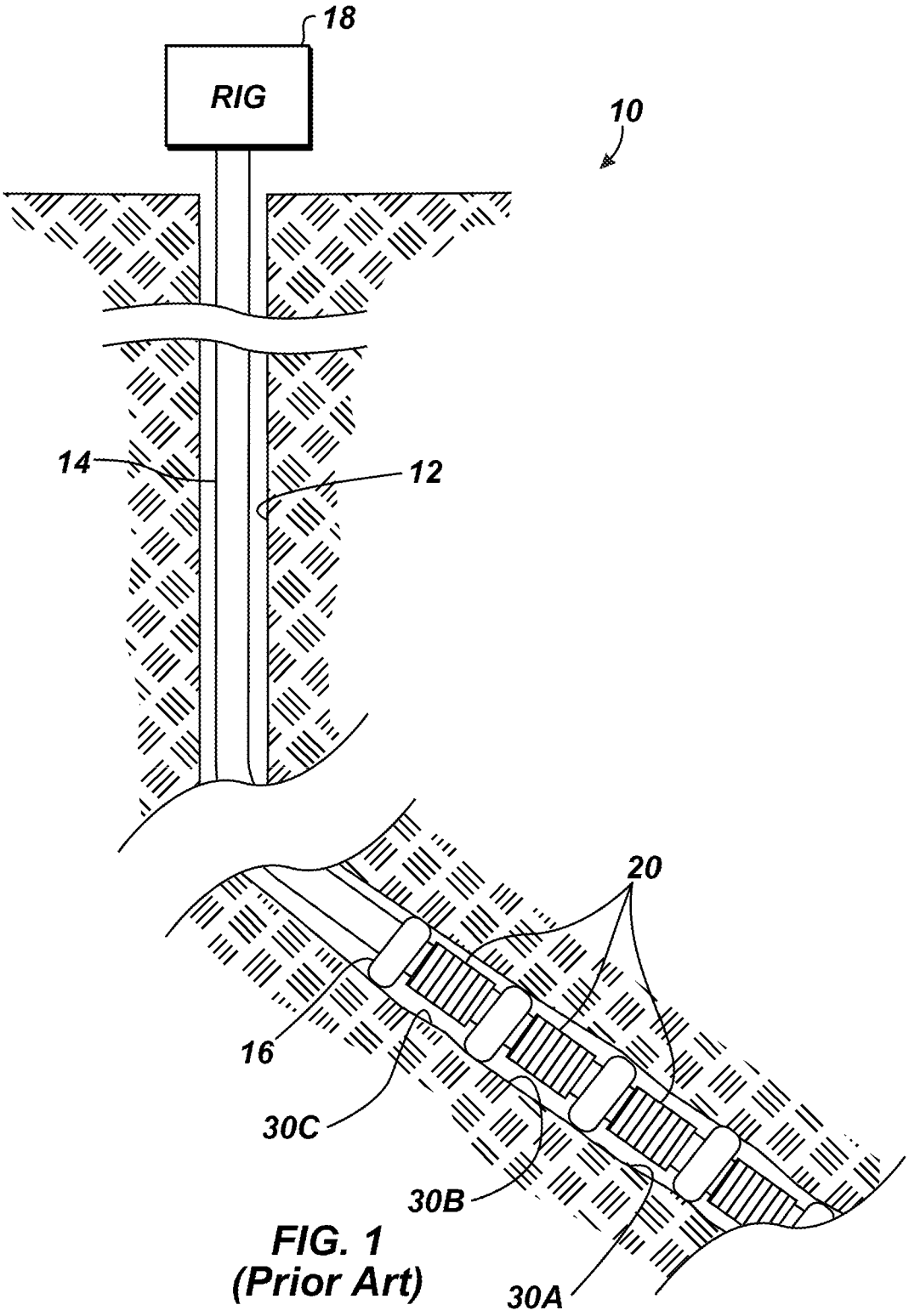
FIG. 1 (Prior Art)
FIG. 1 illustrates a completion system having screen joints according to the prior art deployed in a borehole.
Figure 2A:
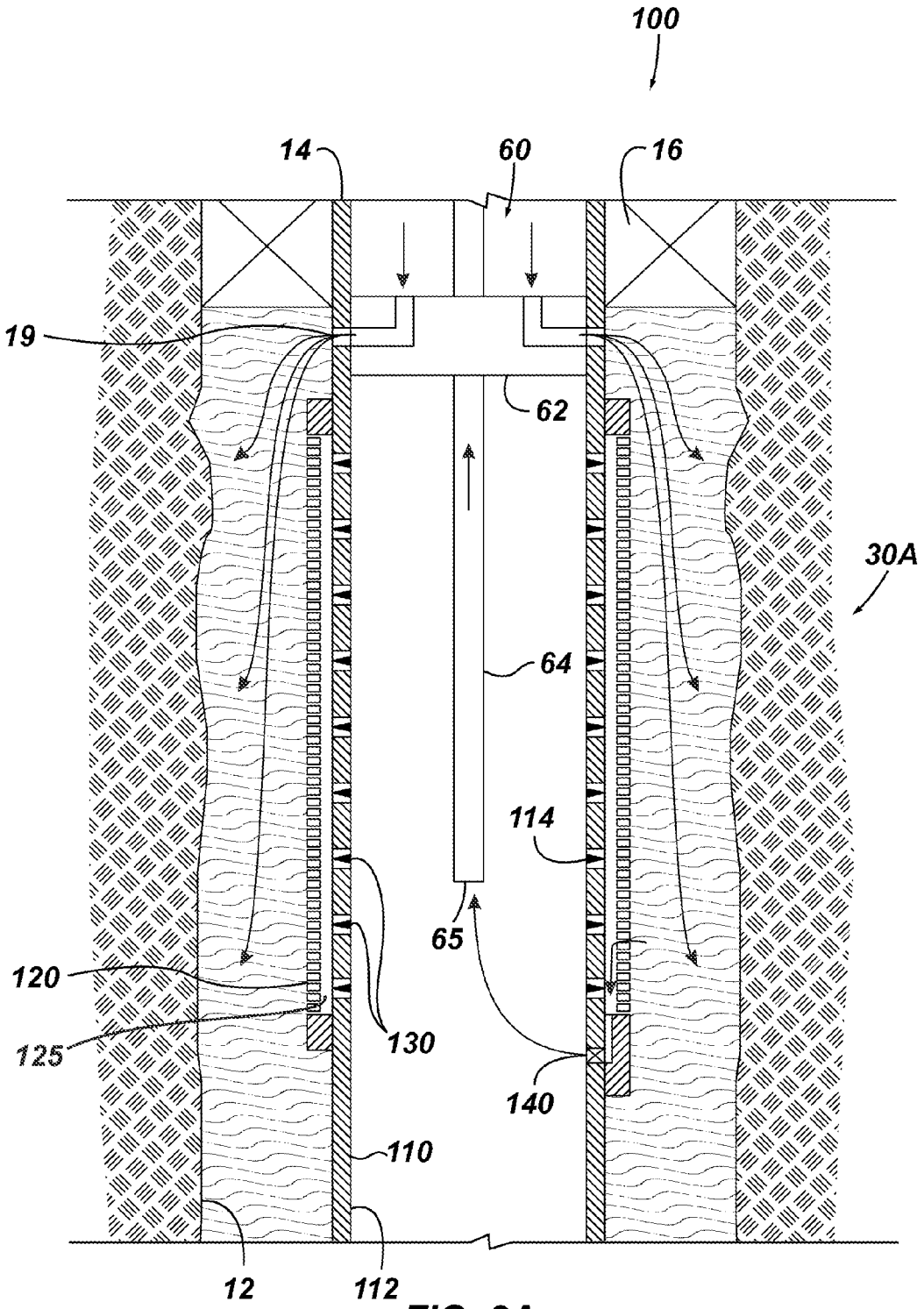
FIGS. 2A-2B illustrate a screen assembly according to the present disclosure during frac-pack and injection operations.
Figure 2B:
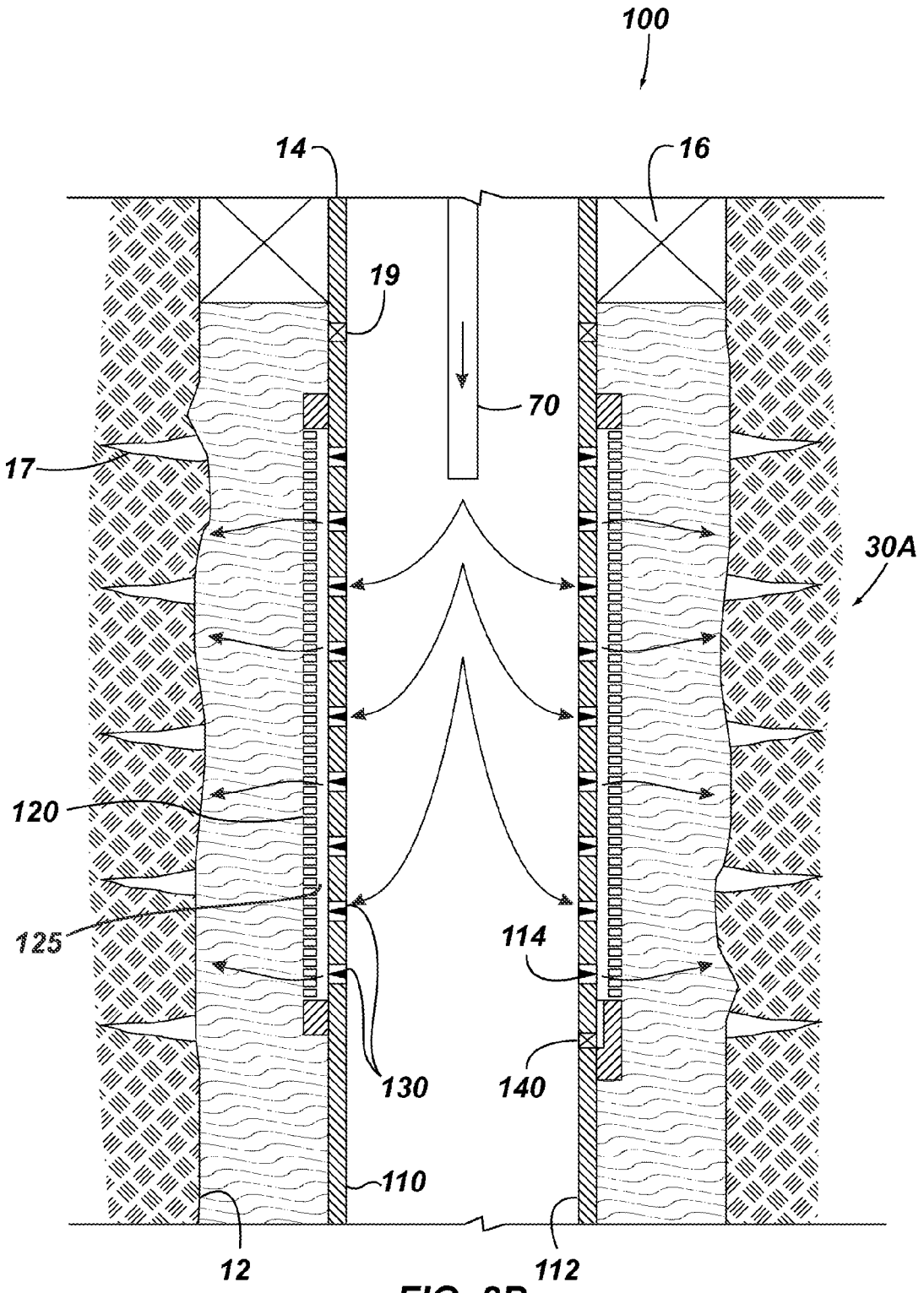

FIGS. 2A-2B illustrate a screen assembly 100 according to the present disclosure during frac pack and injection operations. The screen assembly 100 includes a basepipe 110 having a sand control jacket, filter, or screen 120 disposed thereon. The basepipe 110 defines a through-bore or interior 112 and can have couplings, threads, or the like at the ends (not shown) for connecting to another assembly or to tubulars of a production or work string 14. Inside the through-bore 112, the basepipe 110 defines perforations, slots, ports, or orifices 114 where the jacket 120 is disposed.

For its part, the sand control jacket 120 disposed around the outside of the basepipe 110 covers the perforations 114 and defines an annular gap or drainage layer 125 with the exterior of the basepipe 110. The jacket 120 can use any suitable type of filter medium, such as a wire-wrapped screen, a sintered metal, a perforated tubular, or the like that allows fluid to flow therethrough but prevents particulate matter of sufficient size from flowing therethrough. For example, the jacket 120 can be a wire-wrapped screen having rods or ribs (not shown) arranged longitudinally along the basepipe 110 with windings of wire (not shown) wrapped thereabout to form various slots for passage of fluid and prevention of particulate. Alternatively, the jacket 120 can have a plurality of stacked rings (not shown) with gaps therebetween for passage of fluid and prevention of particulate. Other types of filter media known in the art can be used so that reference to "jacket" or "screen" is meant to convey any suitable type of filter media.

A plurality of outflow or injection valves 130 communicate between the basepipe's bore 112 and the jacket's annular gap 125. (In general, the injection valves 130 can be one-way, check, or ball valves. In particular, the valves 130 as discussed below can use trapped check balls. Although the valves 130 disclosed herein can use such check balls, other types of check valves, poppet valves, one-way valves, or the like can be used.) The injection valves 130 allow fluid to flow from the basepipe's bore 112 to the jacket's gap 125 so the flow can pass out through the jacket 120. However, the valves 130 prevent fluid flow from the gap 125 into the basepipe's bore 112.

To begin a frac pack or gravel pack operation, an upper packer 16 and a lower packer (not shown) may be used to isolate an interval of the borehole 12. Portion of one isolated zone 30A is shown in FIGS. 2A-2B. Downhole of the assembly 100, the tubing string 14 may have any other suitable device (not shown), such as a conventional gravel pack screen, sliding sleeve, completion component, etc.

A cross-over assembly 60 having a washpipe 64 and a cross-over tool 62 can position adjacent to crossover ports 19, which can be disposed in the screen assembly 100 or elsewhere along the isolated interval. Fluid slurry containing gravel, proppant, particulate, or other treatment material is pumped downhole in the tubing 14 and into the isolated borehole annulus via the cross-over tool 62 and the cross-over ports 19.

Exiting the cross-over ports 19, the fluid slurry treats the surrounding formation of the isolated zone 30A. For example, the fluid slurry may be pumped at an elevated, fracture pressure to create fractures 17 (FIG. 2B) in the surrounding formation. Proppant in the pumped slurry can then prop those fractures 17 open. The proppant may also pack inside the borehole annulus surrounding the screen assembly 100.

During this process, fluid returns are not allowed to pass through the jacket 120 and the injection valves 130 back into the assembly 100. In this way, the slurry pumped at the fracture pressure can build up in the annulus and against the surrounding formation.

It may be desirable to eventually allow fluid returns to enter the screen assembly 100 at some point during the process. Therefore, the screen assembly 100 may have one or more return ports 140 for passage of fluid returns into the basepipe's bore 112. The return ports 140 may be open ports or may have inflow valves, movable sleeves, rupture disks, or the like. Once opened or activated, such return ports 140 may allow fluid in the gap 125 between the jacket 120 and the basepipe 110 to enter the basepipe's bore 112 so it can travel into the washpipe's inlet 65 and up the washpipe 64 to the surface. Opening of the return ports 140 can be selectively operated so that fracture treatment can first be achieved and then gravel packing with fluid returns can be initiated once the return ports 140 open. The return ports 140 may even be used for later production operations once the cross-over assembly 60 is removed so that the tubing string 14 with the screen assembly 100 can be used as a production screen during later operations.

In some cases, it may be necessary to isolate the flow of fluid returns from the return ports 140 to the washpipe 64 so that the fluid returns do not open the injection valves 130 on this screen assembly 100 or any other screen assembly (100) along the tubing string 14. Therefore, flow of the fluid returns may be isolated into the washpipe 64 by isolating the washpipe's inlet 65 from the assembly's injection valves 130 using a straddle packer (not shown) on the washpipe 64, using a sleeve (not shown) inside the basepipe 110, using seals and seats (not shown) between the washpipe 64 and the bore 112 inside the basepipe 110, or using some other form of isolation. Further details related to isolation for these purposes are discussed below in relation to FIG. 2C, for example.

As shown in FIG. 2B, once frac-pack operations are completed and fractures 17 are formed, the cross-over assembly 60 may be removed so that injection treatments can be performed. An injection assembly having a workstring 70 can be disposed in the screen assembly 100 to inject treatment fluid in the basepipe's bore 112. Alternatively, instead of using the workstring 70, the injection assembly can have treatment pumped directly down the bore 112 of the basepipe 110, can have a capillary line run in the basepipe 110 for injecting the treatment fluid, or can use some other acceptable procedure and components for injecting the treatment fluid. The treatment can include any suitable type of treatment to be applied to the borehole, including acid, stimulant, steam, biocide, chemical, etc.

While the treatment is pumped, the injection valves 130 permit the treatment to pass from the basepipe's bore 112, into the drainage layer 125, out through the jacket 120, and into the borehole 12 to treat the formation. The treatment can pass through any packed gravel in the annulus and can enter the propped fractures 17 of the formation. Flow back is typically not permitted during the treatment operation. Therefore, the return ports 140 (if present) may be closed or sealed, e.g., by using a straddle packer (not shown) on the workstring 70, using a movable sleeve (not shown) inside the basepipe 110 at the return ports, using seals and seats (not shown) between the workstring 70 and the bore 112 inside the basepipe 110, or using some other form of isolation. Alternatively, the return ports 140 may simply remain open without much detriment to the treatment operation depending on the type of treatment performed and other circumstances.

In some implementations, several screen assemblies 100 may be used along the tubing string 14 for multiple zones. Fluid communication of fracture pressure during operations may be able to communicate inside the tubing string 14 between adjacent assemblies 100, which could cause the injection valves 130 on adjacent assemblies 100 to open and wash out any previous gravel packing. Therefore, in these implementations, it may be necessary to isolate the injection valves 130 on the screen assembly 100 of one zone 30A when frac packing another zone 30B.

Figure 2C:
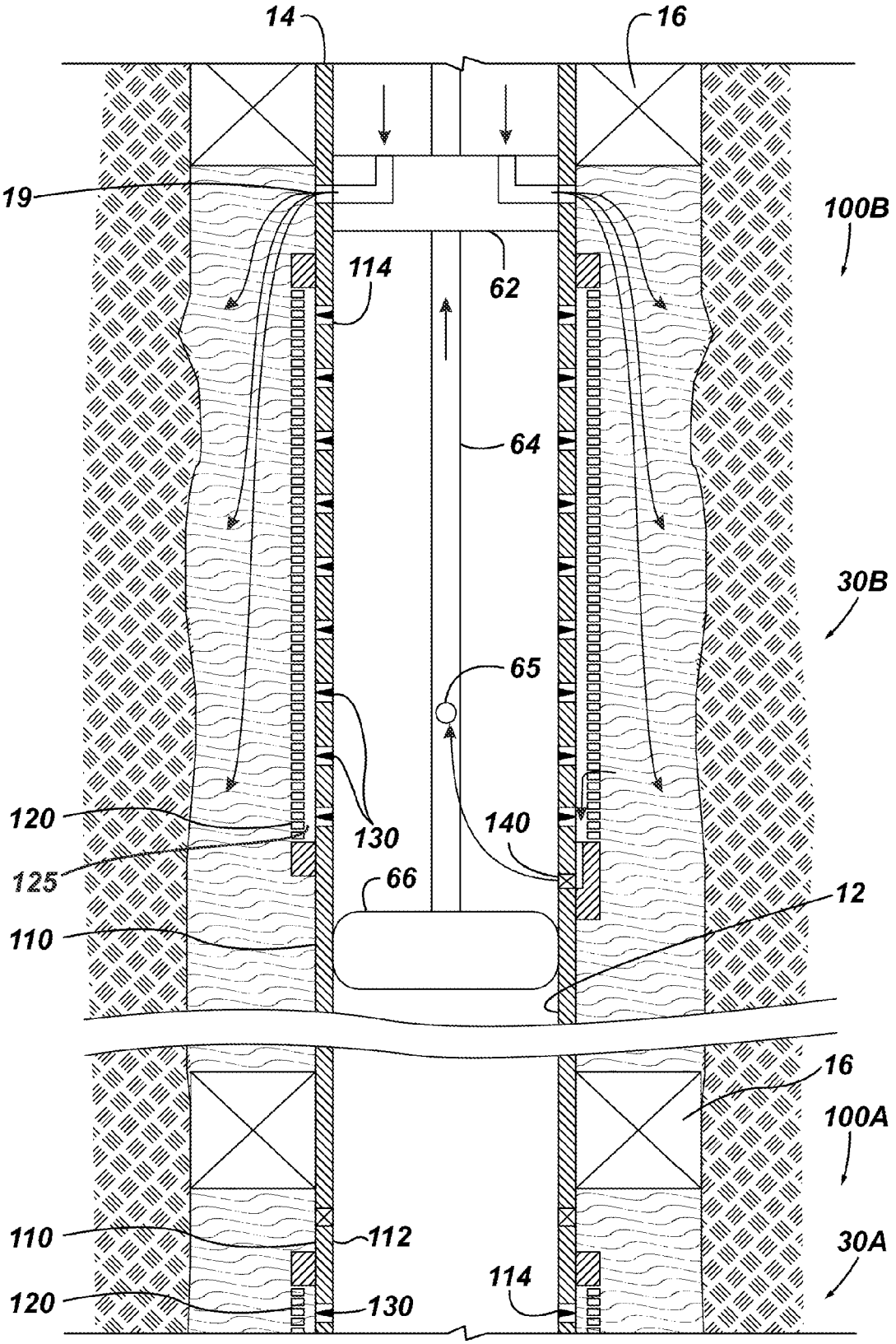
FIGS. 2C-2D illustrate a screen assembly at an additional zone during operations while isolating from a lower zone.

As shown in FIG. 2C, a screen assembly 100B of an upper zone 30B is being frac packed after previous operations have been performed on a lower zone 30A, such as in FIGS. 2A-2B. Here in this upper zone 30B, fluid returns are permitted through one or more return ports 140 on the upper screen assembly 100B. If allowed to communicate insider the tubing string 14 to the screen assembly 100A of the lower zone 30A, the fluid pressure in the tubing string 14 could open the lower assembly's injection valves 130 and potentially damage any gravel packing in the lower zone 30A. Therefore, isolation is provided inside the tubing string 14 between the upper and lower zones 30A-B so that fluid returns in the upper assembly 100B will not reach the injection valves 130 of the lower assembly 100A.

Various forms of isolation can be used. As shown here, for example, the washpipe 64 can have an inlet port 65 to receive the fluid returns from the return port 140 or the like of the upper assembly 100B in the upper zone 30B. However, the washpipe 64 may have a straddle packer, an inflatable packer, or other isolation element 66 to close off the lower assembly 100A in the lower zone 30A. In this way, fluid returns inside the upper zone's assembly 100B can be prevented from affecting the lower zone 30A.

Figure 2D:
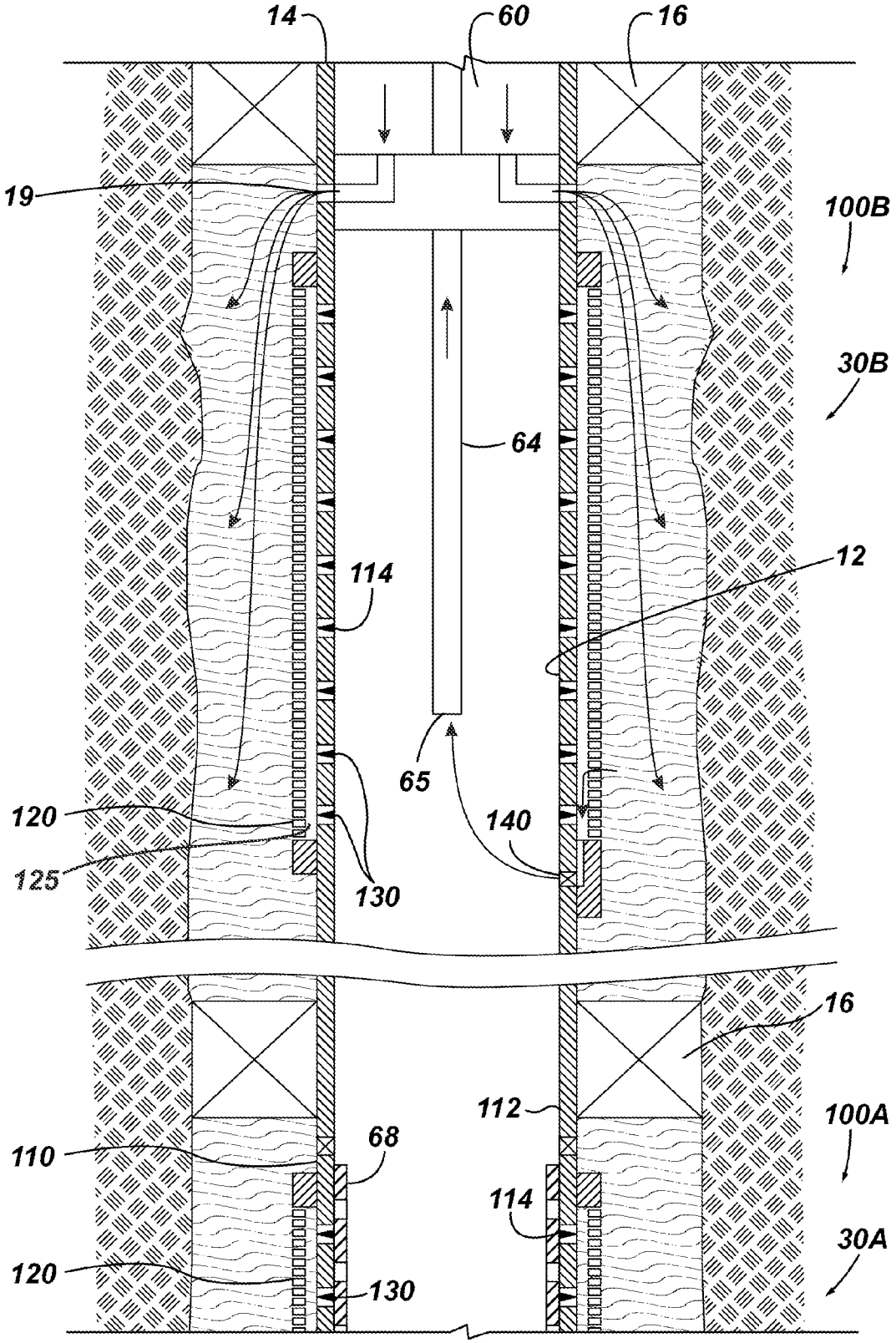

Rather than using an isolation element 66 on the washpipe 62 as shown in FIG. 2C, other forms of isolation can be used. Internal and external seals and seats (not shown) can be provided between the washpipe 62 and the inner dimension of the tubing string 14 or the assembly 100B at the upper zone 30B to prevent fluid returns from the upper zone's return ports 140 or the like from reaching the lower zone's assembly 100A. Alternatively, as shown in FIG. 2D, the lower zone's assembly 100A may have a movable sleeve 68 that can be selectively shifted inside the assembly 100A to open or close fluid communication through the perforations 114 and injection valves 130. Thus, with the sleeve 68 closed on the lower zone's assembly 100A as shown in FIG. 2D, any fluid returns from the return ports 140 or the like from the upper assembly 100B will not be able to act against the injection valves 130 in the lower assembly 100A.

Having an understanding of the screen assembly 100 and how it is used, discussion now turns to particular embodiments of the jacket 120 and injection valves 130 of the disclosed screen assembly 100.

Figure 3A:
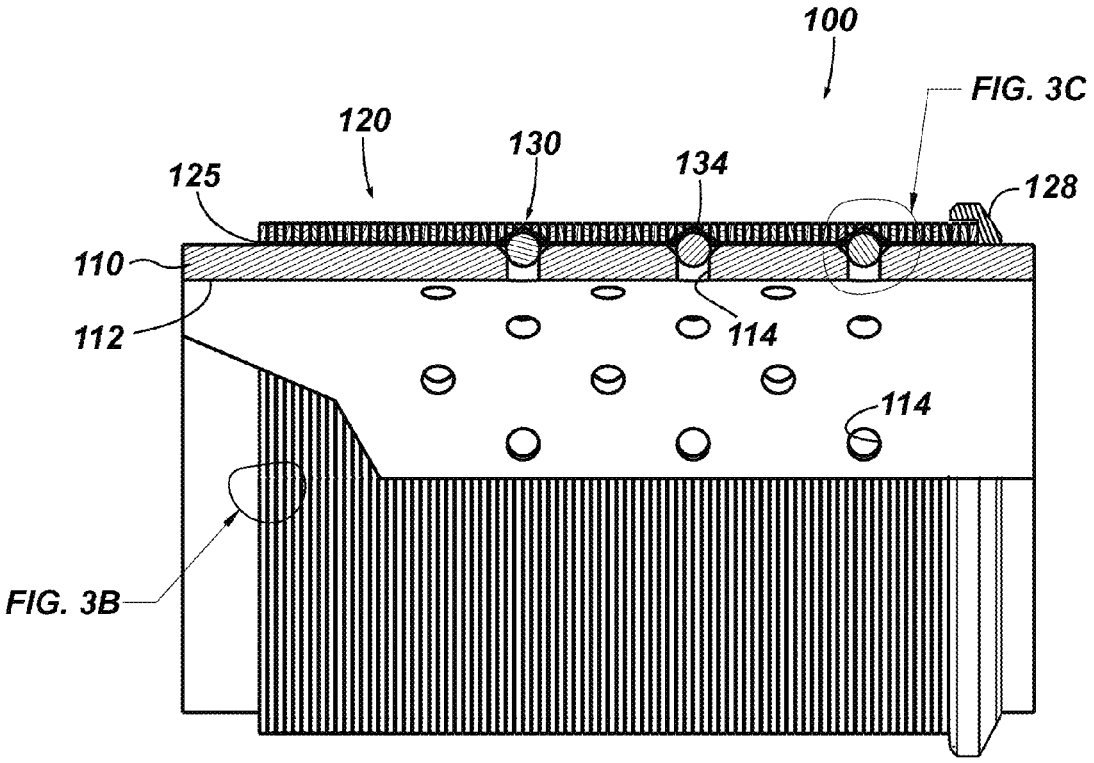
FIG. 3A illustrates a portion of the disclosed screen assembly in partial cross-section.

FIG. 3A illustrates a portion of a screen assembly 100 according to one embodiment in partial cross-section. FIGS.

3B and 3C shows isolated views of portions of the assembly 100 in FIG. 3A. For the jacket 120, the screen assembly 100 in this embodiment uses a plurality of rings 122 made from (or coated with) an erosion resistant material. The rings 122 are stacked on the exterior of the basepipe 110 in an arrangement that maintains spacing or slots (S) between them adequate for sand control between the rings 122 (i.e., to permit fluid flow but prevent certain particulates from passing).

An end ring or other component can be disposed on the basepipe 110 at one or both ends of the jacket 120 to secure the rings 122 in place on the basepipe 110. For example, one such end ring 128 is shown disposed on the basepipe 110 in FIG. 3A. Alternatively, one or more of the rings 122 may be affixed (e.g., welded, brazed, etc.) to the basepipe 110 to hold the jacket 120 in place. The rings 122 may also define feet or tabs (not shown) around their inner circumferences to hold the rings 122 at a spaced distance from the exterior of the basepipe 110 to create an annular gap for the drainage layer 125.

Figure 3B:
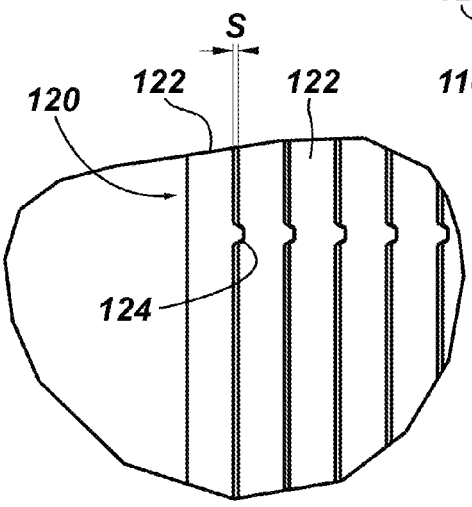
FIG. 3B illustrates a detail of alignment features on the stacked rings of the disclosed screen assembly.

As best shown in the detail of FIG. 3B, the rings 122 may have alignment features 124, such as teeth and detents on the sides of the rings 122. As the jacket 120 is manufactured, the alignment features 124 align and space the rings 122 relative to one another as they are stacked along the length of the basepipe 110 at a defined spacing (S).

Figure 3C:
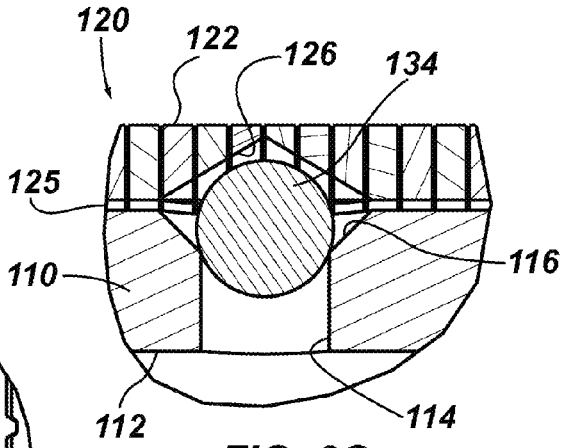
FIG. 3C illustrates a detail of a check ball disposed in a basepipe perforation and captured by the stacked rings.

As best shown in FIG. 3C, at least some of the rings 122 also have pocket features 126 defined around their inner circumferences. These pocket features 126 align with or position over the pattern of basepipe perforations 114. As the rings 122 are stacked on the basepipe 110 during manufacture, erosion resistant check balls 134 are disposed in widened seats 116 of the perforations 114, and the check balls 134 are enclosed by the ring's pocket features 126.

The captured check balls 134 serve as one-way check valves for the perforations 114 during frac-pack or flow-back processes, as discussed previously. Accordingly, flow out of the basepipe 110 is allowed through the perforations 114, past the check balls 134, and out the screen of stacked rings 122 during injection operations. However, during frac-pack or flow-back operations, the check balls 134 seat in the perforations 114 and prevent fluid flowing through the stacked rings 122 and into the basepipe 110 through the perforations 114.

Thus, depending on the direction of flow, the check balls 134 can be moved in the space defined by the pocket features 126 and the seats 116. The annular gap of the drainage layer 125 around the inside circumference of the jacket 120 allows fluid to flow along the outside of the basepipe 110. When the check ball 134 is unseated and moved against the pocket features 126 of the adjacent rings 122 during injection, fluid can flow along the layer 125 and also through the slots (S) between the rings 122.

By contrast, when the check ball 134 is seated and moved against the seat 116 of the adjacent perforation 114 during frac-pack or flow back, at least most of the fluid cannot pass into the basepipe 110. Flow may be allowed to pass through the slots (S) between the rings 122, and the screened fluid can then flow along the annular gap of the drainage layer 125. As noted above, the flow of screened fluid along the annular layer 125 may eventually be allowed to enter the basepipe 110 through a return port, a valve, sleeve, rupture disk, or other feature (140: FIGS. 2A-2B). Further details of some arrangements for this flow return are disclosed below with reference to FIGS. 5A-5B.

Figure 4A:
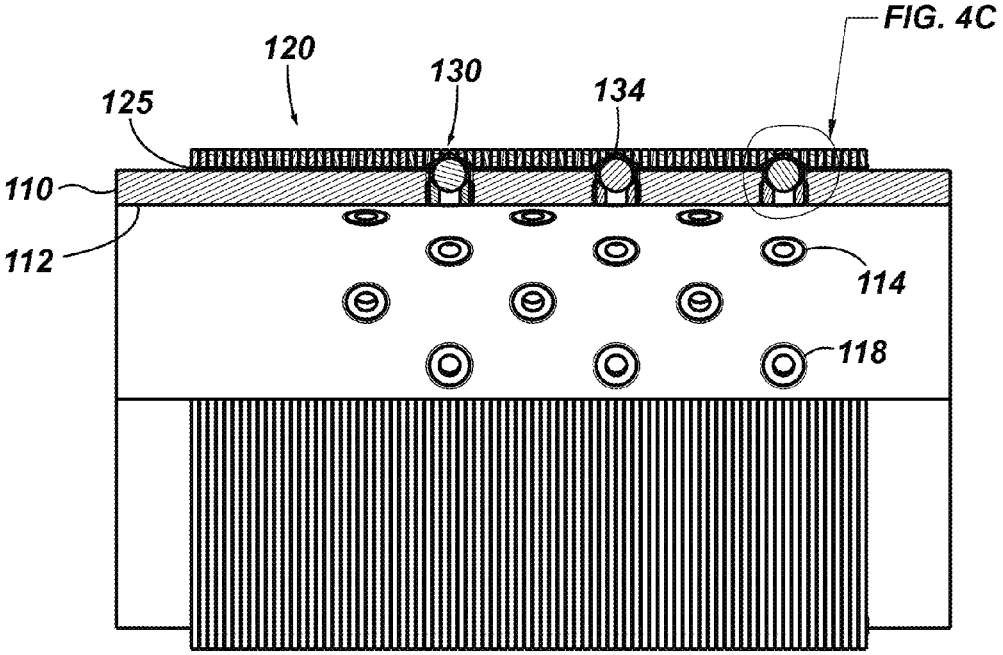
FIG. 4A illustrates a portion of another screen assembly in partial cross-section.
Figure 4B:
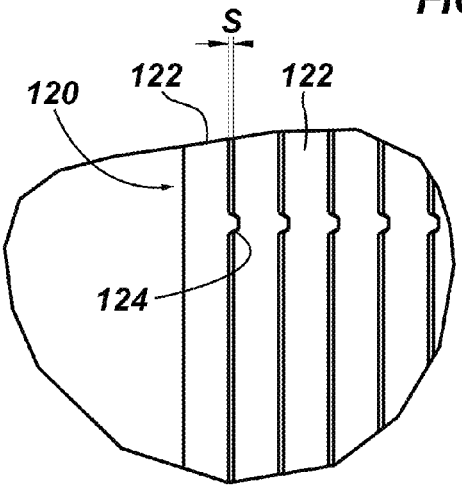
FIG. 4B illustrates a detail of alignment features on the stacked rings of the disclosed screen assembly.

Another embodiment of a screen assembly 100 is illustrated in FIG. 4A, which shows a portion of the screen assembly 100 in partial cross-section. Again, the assembly's jacket 120 in this embodiment uses a plurality of rings 122 made from (or coated with) an erosion resistant material. The rings 122 are stacked on the exterior of the basepipe 110 in an arrangement that maintains spacing or slots (S) adequate for sand control between the rings 122. As best shown in the detail of FIG. 4B, the rings 122 may have alignment features 124, such as teeth and detents on the sides, which align and space the rings 122 relative to one another as they are stacked along the length of the basepipe 122.

Figure 4C:
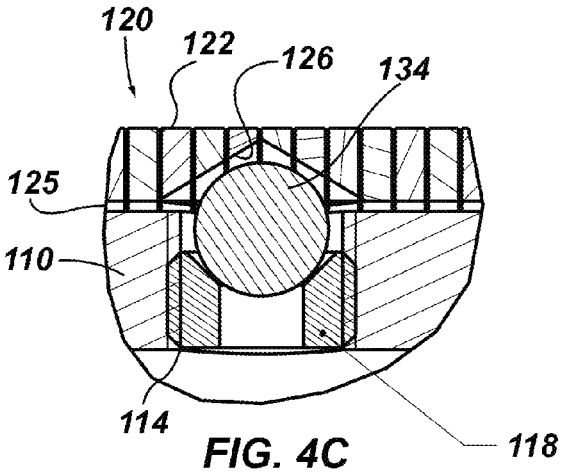
FIG. 4C illustrates a detail of a check ball disposed in a basepipe perforation and captured by the stacked rings and an insert.

As best shown in FIG. 4C, the rings 122 also have pocket features 126 defined around their inner circumferences, which align with the pattern of basepipe perforations 114. As the rings 122 are stacked on the basepipe 110 during manufacture, erosion resistant check balls 134 are disposed in the perforations 114 to be enclosed by the ring's pocket features 126.

Rather than engaging against a seat formed in the perforations 114 as in the previous arrangement, the check balls 134 engage against inserts 118 affixed inside the perforations 114. For example, the inserts 118 can be composed of an erosion resistant material and can thread, tack weld, or otherwise affix in the perforations 114 of the basepipe 110. The captured balls 134 can move open or closed relative to the inserts 118 to serve as check valves during frac-pack or flow-back operations. Accordingly, flow out of the basepipe 110 is allowed through the perforations 112 and the inserts 118, past the check balls 134, and out the screen of stacked rings 122 during injection operations. However, during frac-pack or flow-back operations, the check balls 134 prevent fluid flowing into the basepipe 110 through the perforations 114 and the inserts 118.

Using the inserts 118 can have a number of advantages. For instance, the order of manufacture can be altered. In this case, instead of installing the check balls 134 in the perforations 114 as the jacket 120 is formed, the check balls 134 can be inserted from inside the basepipe's bore 112 after the jacket 120 is positioned outside the basepipe 110. Then, the inserts 118 can be installed to capture the check balls 118.

In another advantage, the inserts 118 can be configured with a particular orifice size—as can the balls 134—so that a standard basepipe 110 with uniform sizes of perforations 114 can be selectively configured with inserts 118 and check balls 134 of one or more sizes. Additionally, the inserts 118 can prevent or reduce the erosion that may occur during injection so that the check balls 134 are less likely to escape their entrapment if the perforations 114 were subject to erosion.

Figure 5A:
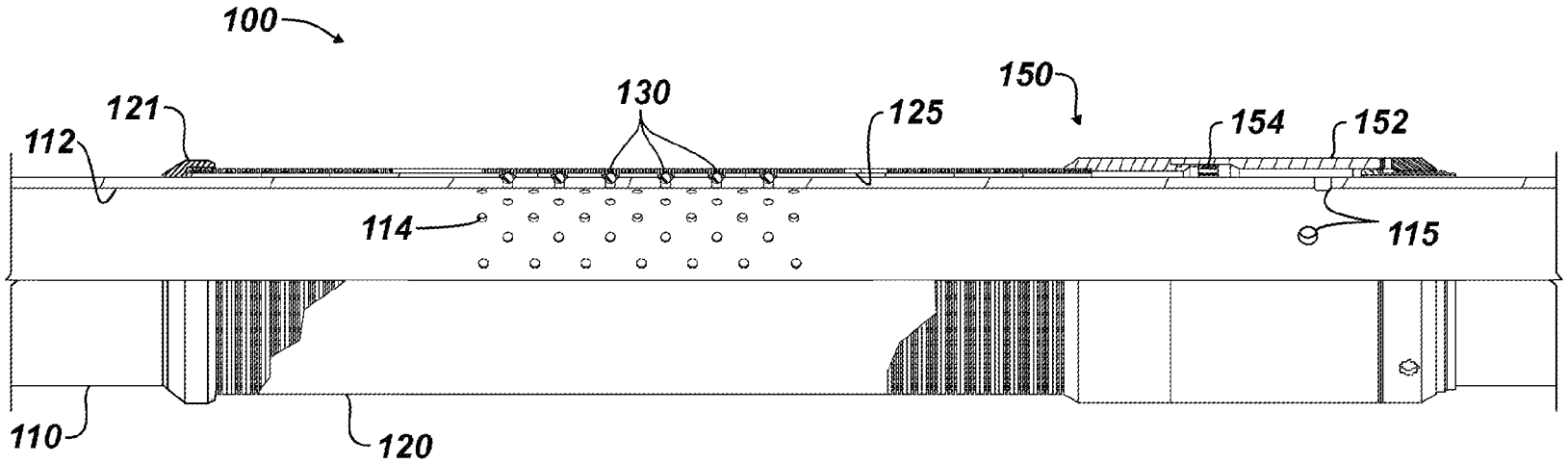
FIG. 5A illustrates, in partial cross-section, another screen assembly according to the present disclosure having a screen disposed on a basepipe in conjunction with an inflow control device.

As disclosed herein, the screen assembly 100 can be used on its own as an injection screen. In other arrangements, the assembly 100 can be used with a return port, a valve, a sleeve, a rupture disk, or other such feature (140: FIGS. 2A-2B) that allows flow back of screened fluid into the assembly 100. In a similar fashion, a screen assembly 100 illustrated in partial cross-section in FIG. 5A is a combination of injection and production assembly. The screen assembly 100 shown in FIG. 5A uses the previously described features of a screen jacket 120 and injection valves 130 in combination with an inflow control device 150, which can allow flow back of screened fluid in a similar fashion as the return ports (140) discussed previously.

Again as shown in FIG. 5A, the assembly 100 includes a basepipe 110 surrounded by the screen jacket 120, which can be composed of a filter media, wire-wrapped screen, stacked rings, etc. Additionally, the basepipe 110 has perforations 114 with the injection valves 130. An end ring 121 can be disposed at one end of the jacket 120 to close off fluid flow along the annular drainage layer 125 between the jacket 120 and the basepipe 110. The other end of the jacket 120 connects with the inflow control device 150 so that screened fluid flow passing along the drainage layer 125 can pass into the inflow control device 150.

The inflow control device 150 includes an outer housing or sleeve 152 and has one or more nozzles or flow restrictions 154 inside that create a pressure drop in the flow of fluid from the annular gap 125 to additional ports or perforations 115 in the basepipe 110. The purpose of the inflow control device 150 is to control flow of fluid into the screen assembly 100—particularly to control the flow of production fluid during production operations.

During production, for example, reservoir fluids travel through the jacket 120 and into the drainage layer 125 between the jacket 120 and the basepipe 110. The injection valves 130 prevent the flow from entering directly into the basepipe 110 through the perforations 114. Instead, the produced fluid passes along the drainage layer 125 to the inflow control device 150. Entering the housing 152, the flow passes through the flow restrictions 154 (e.g., tungsten carbide nozzles) before passing through the ports 115 in the basepipe 110. The flow restrictions 154 produce a pressure drop in the fluid, and the size and/or number of the restrictions 154 can be configured for a given implementation.

At times before or during production, treatment operations may be performed to treat the formation surrounding the assembly 100. For example, the screen assembly 100 of FIG. 5A can be used for frac pack operations similar to those described above. In this case, fracture treatment can be introduced into the annulus around the screen assembly 100 from a cross-over or the like. The injection valves 130 prevent the flow of returns, production fluid, or the like from passing from the screen jacket 125 to the basepipe 110 without passing through the inflow control device 150. Fluid returns through the inflow control device 150 can be prevented by isolating or covering the inner ports 115 of the basepipe 110 in a manner discussed previously. Alternatively, fluid returns through the inflow control device 150 may be permitted and may not adversely affect the treatment.

As before, the screen assembly 100 of FIG. 5A can also be used for injection operations. In this case, injection fluid pumped or introduced in the basepipe 110 may be allowed to pass through the perforations 114 and injection valves 130. Yet, the injection fluid may also be allowed to pass through the ports 115 and the inflow control device 150 to the screen jacket 120. Although this may be effective for some injection operations, the arrangement of the ports 115, the flow restrictions 154, and the like can limit the injection rates that can be achieved. In any event, the injection valves 130 under the screen jacket 120 allow for increased injection rates to be achieved with the disclosed assembly 100.

Figure 5B:
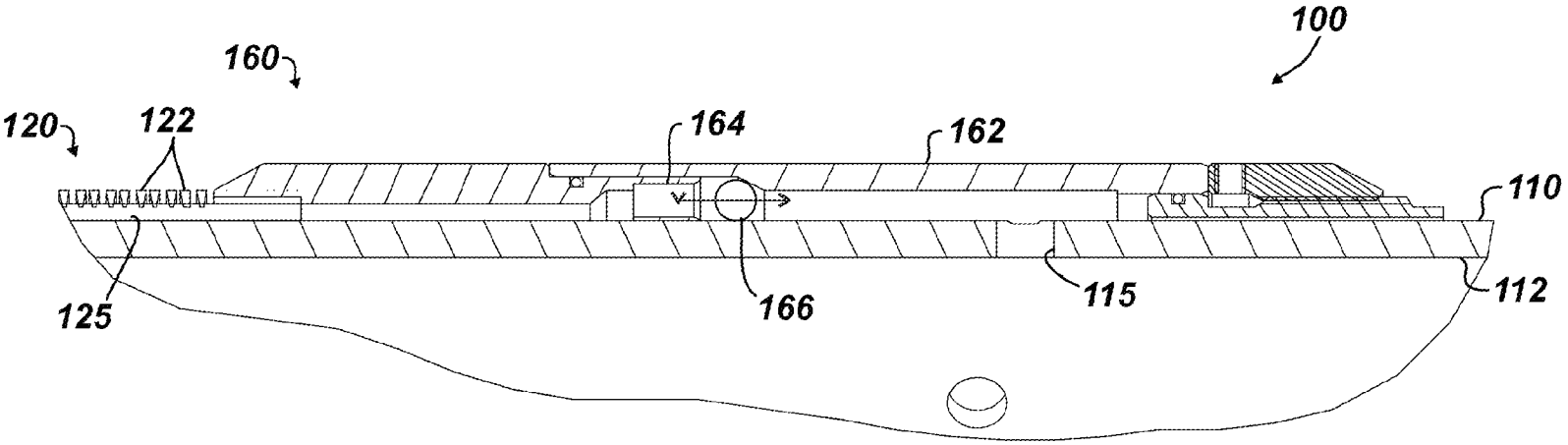
FIG. 5B illustrates, in detailed cross-section, another inflow control device that can be used in conjunction with the disclosed screen assembly.

FIG. 5B illustrates an end of the disclosed screen assembly 100 having another type of inflow control device 160 that may be used in a similar fashion as the return ports (140) discussed previously. This device 160 includes a housing or sleeve 162 disposed on the basepipe 110. A restriction, nozzle, or seat 164 is disposed in the housing 162, and an inflow valve in the form of a check ball 166 can allow flow from the screen jacket 120, through the device 160, and into the basepipe's ports 115. However, the check ball 166 prevents reverse flow from the basepipe 110 through the device 160. This type of inflow control device 160 used with the disclosed screen jacket 120 and injection valves (130) of the screen assembly 100 can have a number of similar advantages and uses.

During production, for example, reservoir fluids travel through the screen jacket 120 and into the drainage layer 125 between the jacket 120 and the basepipe 110. The injection valves (130) prevent the flow from entering directly into the basepipe 110 through the perforations (114). Instead, the produced fluid passes along the drainage layer 125 to the inflow control device 160. Entering the device's housing 162, the flow passes through the flow restrictions or seats 164 and passes the check balls 166 before passing through the ports 115 in the basepipe 110. (Although the valve disclosed herein uses check balls 166 and seats 164, other types of check valves, poppet valve, one-way valves, or the like can be used.) The flow restrictions 154 produce a pressure drop in the fluid, and the size and/or number of the restrictions 154 can be configured for a given implementation.

At times before or during production, treatment operations may be performed to treat the formation surrounding the assembly 100. For example, the screen assembly 100 of FIG. 5B can be used for frac pack operations similar to those described above. In this case, fracture treatment can be introduced into the annulus around the screen assembly 100 from a cross-over or the like. The injection valves (130) prevent the flow of returns, production fluid, or the like from passing from the screen jacket 120 to the basepipe 110 without passing through the inflow control device 160. Fluid returns through the inflow control device 160 can be prevented by isolating or covering the inner ports 115 of the basepipe 110 with a plug or tool disposed inside the bore 112. Alternatively, fluid returns through the inflow control device 160 may be permitted and may not adversely affect the treatment.

As before, the screen assembly 100 of FIG. 5B can also be used for injection operations. In this case, injection fluid pumped or introduced in the basepipe 110 may be allowed to pass through the perforations (114) and injection valves (130). Yet, the injection fluid is not allowed to pass through the ports 115 and the inflow control device 160 to the screen jacket 120 due to the internal injection valves formed by the check balls 166 and flow restriction 164.

As noted above, the assemblies 100 disclosed herein can be used for injection operations alone or used for injection and production operations. In addition, the disclosed assemblies 100 can be used for pressure control and well kill operations. For example, a reservoir section of a well is typically kept under positive pressure that acts to force reservoir fluids into the reservoir completion. During completion, work over, intervention, and other operational periods when the well is not being produced, the reservoir pressure must be controlled to prevent reservoir fluids from migrating into the reservoir completion and to surface. This is typically achieved by filling the well with a weighted fluid that will counteract the reservoir pressure. The disclosed assemblies 100 having the injection valve 130 will readily allow such weighted fluid to flow into the annulus and counteract the reservoir pressure.

At times, well kill operations may need to be performed in a reservoir completion because fluid is being lost to the formation. In the well kill operation, a loss prevention fluid is used to prevent the loss of fluid flow to the surrounding formation. For example, a situation can arise where the balance between the fluid weight and the reservoir pressure is lost, and fluid either begins to flow into or out of the reservoir in an uncontrolled manner. In these situations, it is necessary to re-gain control of the fluid balance through a process called "killing the well."

Killing the well is typically achieved by circulating a weighted fluid into the well that places a significantly high enough pressure against the wellbore to overcome the reservoir pressure. It may also be necessary to prevent this weighted fluid from continuing to leak into the reservoir section. This is achieved by mixing a Loss Control Material (LCM) in with the weighted fluid. The material can be made up of solid particles of a specific size that are designed to rest against the area where the fluid is leaking into the reservoir section. As fluid leaks past the area, the solid particles bridge off at the area and plug off the leak temporarily.

Figure 6A:
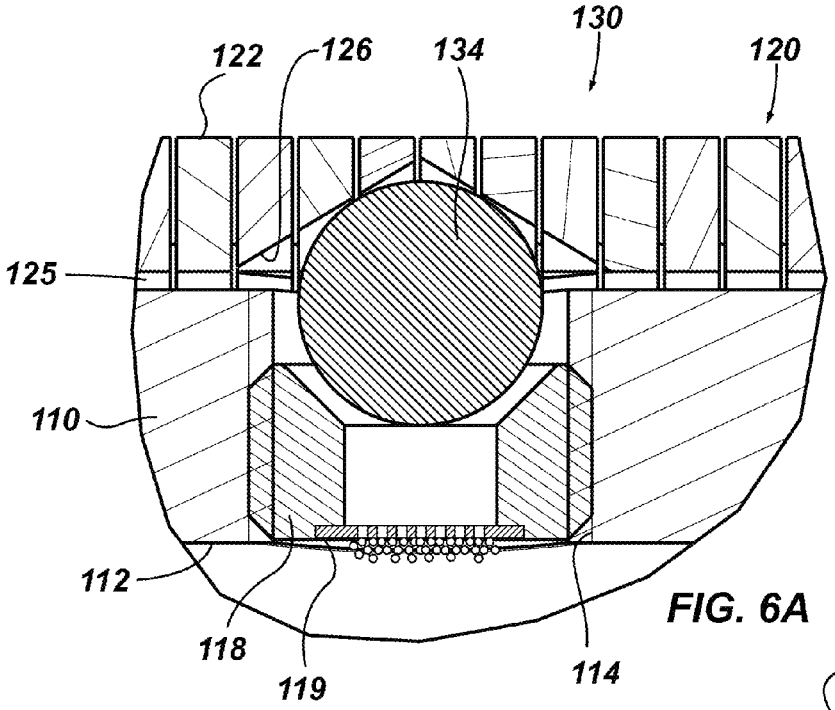
FIGS. 6A-6C illustrate detailed views of particulate material in a fluid loss prevention operation bridging off in portions of the disclosed screen assembly.

The assemblies 100 disclosed can be used for these situations. In particular, particulate material in weighted fluid can be communicated downhole in a well kill operation. If fluid is leaking into the reservoir section adjacent the assembly 100, the particulate material in the weighted fluid can pass to the basepipe's perforations 114. If the assembly 100 is used exclusively for injection as with the assemblies 100 of FIG. 3A or 4A, then the basepipe's perforations 114 or the inserts 118 can have filter media disposed at the openings facing the bore 112 against which the particulate material can bridge. (For example, FIG. 6A shows an insert 118 having a filter 119 against which particulate material in weighted fluid can bridge off to prevent fluid loss during operations.) Once the balance between the fluid in the wellbore and the reservoir pressure has been re-established, the fluid from the well can be produced to the surface in a controlled manner that will lift the particulate material away from any filter media (e.g., filter 119) at perforations 114 or inserts 118 and re-establish the flow path.

Figure 6B:
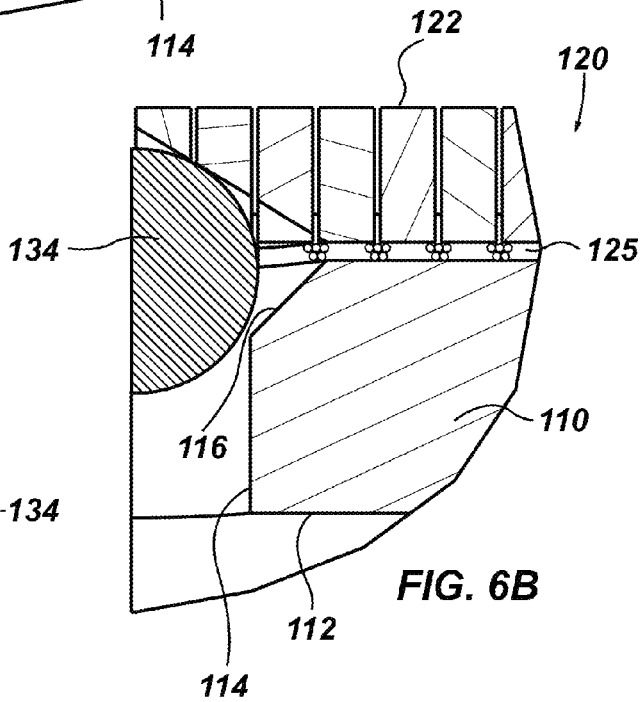
Figure 6C:
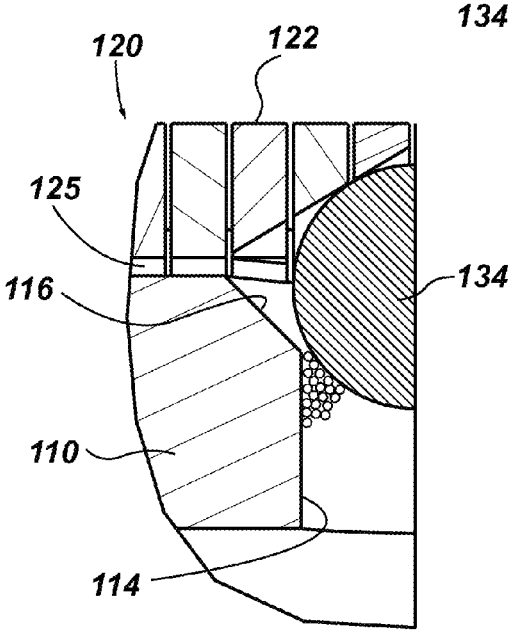

If the assembly 100 is used for injection and production as with the assemblies 100 of FIG. 5A or 5B, then the particulate material in weighted fluid can then bridge off against the inside diameter of the screen jacket 120. In addition (or as an alternative), the particulate material can collect at the check ball 134. (For example, FIGS. 6B-6C show particulate material in weighted fluid bridging off against the screen jacket 120 and the injection valve 130 to prevent fluid loss during operations. For the arrangement in FIG. 6B, flow back of the particulate material bridging off against the screen jacket 120 would need to be through a return port, an ICD, or the like (not shown) on the assembly 100 because the valves 130 would close off fluid flow back through the perforations 114.)

Once the balance between the fluid in the wellbore and the reservoir pressure has been re-established, the fluid from the well can be produced to the surface in a controlled manner that will lift the particulate material away from the inside of the screen joint 120 and out the inflow control device 150/160 to re-establish the flow path. In any event, the basepipe's perforations 114 or the inserts 118 for these dual-purpose assemblies 100 can have filter media disposed at the openings facing the bore 112 against which the particulate material in weighted fluid can bridge.

In some embodiments, the check balls 134 can be composed of erosion resistant material, such as an erosion resistant metal. In such circumstances, the check balls 134 may be expected to remain permanently during use to block flow back. Should one of the balls 134 fail, erode, or the like, then return fluid flow back through the now open perforation 114 would at least be screened of particulate by the screen jacket 120.

As an alternative to permanent check balls 134, the balls 134 may be removable (e.g., composed of a material to eventually dissolve, erode, or break apart) from the perforations 114 so that the injection assembly 100 becomes a type of production screen after a period of time. With the check balls 134 gone, the assembly 100 would allow fluid flow into the basepipe 110 through the jacket 120 and perforations 114. In yet another alternative, the balls 134 may or may not be of a permanent type of material, but the inserts 118 as used in FIGS. 4A and 4C may be removable (i.e., composed of a material to eventually dissolve, erode, or otherwise be removed from the perforations 114), allowing the balls 134 to escape and remove from the perforations 114.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus for controlling fluid flow in a borehole, comprising:

a basepipe having an interior and defining at least one first orifice, the interior conveying the fluid flow, the at least one first orifice communicating the interior with the borehole;

a first filter disposed on the basepipe adjacent the at least one first orifice and filtering the fluid flow communicated between the interior and the borehole, wherein the first filter and the basepipe define a gap therebetween communicating the fluid flow;

at least one first outflow valve disposed at the at least one first orifice, the at least one first outflow valve permitting communication of the fluid flow in an outflow direction from the interior to the borehole and preventing communication of the fluid flow in an inflow direction from the borehole into the interior;

a flow device in fluid communication with the gap and communicating the gap with the interior of the basepipe; and a cross-over assembly operable in a first operation communicating the fluid flow to the borehole, the at least one first outflow valve preventing communication of returns of the fluid flow from the first operation in the inflow direction into the interior, the flow device permitting the returns in the inflow direction into the interior.

2. The apparatus of claim 1, wherein the at least one first outflow valve comprises a ball movable between engaged and disengaged conditions relative to a portion of the at least one first orifice.

3. The apparatus of claim 2, wherein the at least one first outflow valve comprises an insert affixed in the at least one first orifice, the ball engageable against the insert.

4. The apparatus of claim 2, wherein the first filter is disposed on the basepipe external to the at least one orifice and holds the ball adjacent the at least one first orifice.

5. The apparatus of claim 2, wherein the ball is removable from the at least one orifice.

6. The apparatus of claim 1, wherein the first filter comprises a plurality of rings stacked adjacent one another on an exterior of the basepipe.

7. The apparatus of claim 6, wherein at least some of the rings define at least one pocket disposed external to the at least one first orifice, the at least one pocket of the at least some rings capturing a portion of the at least one first outflow valve disposed at the at least one first orifice.

8. The apparatus of claim 1, further comprising at least one second outflow valve disposed at at least one second orifice on the basepipe, the at least one second outflow valve permitting communication of the fluid flow in the outflow direction from the interior to the borehole and preventing communication of the fluid flow in the inflow direction from the borehole into the interior, wherein the cross-over assembly prevents the returns in the interior from the flow device from communicating with the at least one second outflow valve.

9. The apparatus of claim 1, further comprising at least one second outflow valve disposed at at least one second orifice on the basepipe, the at least one second outflow valve permitting communication of the fluid flow in the outflow direction from the interior to the borehole and preventing communication of the fluid flow in the inflow direction from the borehole into the interior, wherein a sleeve disposed on the basepipe selectively prevents the returns in the interior from the flow device from communicating with the at least one second outflow valve.

10. The apparatus of claim 1, further comprising an injection assembly operable in a second operation communicating the fluid flow into the interior of the basepipe, the at least one first outflow valve permitting communication of the fluid flow from the second operation in the outflow direction from the interior to the borehole.

11. The apparatus of claim 1, wherein the flow device comprises a flow restriction restricting the fluid flow from the gap into the interior of the basepipe.

12. The apparatus of claim 1, wherein the flow device comprises at least one inflow valve permitting communication of the fluid flow in the inflow direction from the gap to the interior and preventing communication of the fluid flow in the outflow direction from the interior to the gap.

13. The apparatus of claim 1, wherein the first filter filters the fluid flow communicated in the inflow direction from the borehole to the interior and prevents particulate from passing therethrough.

14. The apparatus of claim 1, wherein the first filter bridges off with particulate in the fluid flow communicated in the outflow direction from the interior to the borehole.

15. The apparatus of claim 1, further comprising a second filter disposed adjacent the at least one first orifice and bridging off with particulate in the fluid flow communicated in the outflow direction from the interior to the borehole.

16. The apparatus of claim 1, wherein the at least one first outflow valve bridges off with particulate in the fluid flow communicated in the outflow direction from the interior to the borehole.

17. A method for controlling fluid flow in a borehole, the method comprising:

communicating, through at least one first orifice in a basepipe, the fluid flow between an interior of the basepipe and the borehole;

filtering, through a first filter at the at least one first orifice, the fluid flow communicated between the interior and the borehole;

permitting, through at least one first outflow valve at the at least one first orifice, communication of the fluid flow in an outflow direction from the interior to the borehole; and preventing, through the at least one first outflow valve at the at least one first orifice, communication of the fluid flow in an inflow direction from the borehole into the interiors;

permitting communication of the fluid flow in a gap between the first filter and the basepipe;

permitting, through at least one inflow valve, communication of the fluid flow from the gap to the interior; and preventing, through the at least one inflow valve, communication of the fluid flow from the interior to the gap.

18. The method of claim 17, wherein permitting communication of the fluid flow in the outflow direction comprises disengaging a ball of the at least one first outflow valve relative to a portion of the at least one first orifice.

19. The method of claim 18, wherein preventing communication of the fluid flow in the inflow direction comprises engaging the ball of the at least one first outflow valve relative to the portion of the at least one first orifice.

20. The method of claim 18, wherein disengaging the ball of the at least one first outflow valve relative to the portion of the at least one first orifice comprises holding the ball with the first filter at the at least one first orifice.

21. The method of claim 17, further comprising restricting the fluid flow from the gap into the interior.

22. The method of claim 17, wherein filtering the fluid flow communicated between the interior and the borehole comprise filtering with the first filter the fluid flow communicated from the borehole to the interior and preventing particulate from passing therethrough.

23. The method of claim 17, further comprising bridging off with particulate in the fluid flow from the interior to the borehole in a fluid loss operation.

24. An apparatus for controlling fluid flow in a borehole, comprising:

a basepipe having an interior and defining at least one first orifice, the interior conveying the fluid flow, the at least one first orifice communicating the interior with the borehole;

a first filter disposed on the basepipe adjacent the at least one first orifice and filtering the fluid flow communicated between the interior and the borehole; and at least one first outflow valve disposed at the at least one first orifice, the at least one first outflow valve permitting communication of the fluid flow in an outflow direction from the interior to the borehole and preventing communication of the fluid flow in an inflow direction from the borehole into the interior, wherein the first filter comprises a plurality of rings stacked adjacent one another on an exterior of the basepipe, and wherein at least some of the rings define at least one pocket disposed external to the at least one first orifice, the at least one pocket of the at least some rings capturing a portion of the at least one first outflow valve disposed at the at least one first orifice.

25. The apparatus of claim 24, wherein the at least one first outflow valve comprises a ball movable between engaged and disengaged conditions relative to a portion of the at least one first orifice.

26. The apparatus of claim 25, wherein the at least one first outflow valve comprises an insert affixed in the at least one first orifice, the ball engageable against the insert.

27. The apparatus of claim 24, wherein the first filter filters the fluid flow communicated in the inflow direction from the borehole to the interior and prevents particulate from passing therethrough.

28. The apparatus of claim 24, wherein the first filter bridges off with particulate in the fluid flow communicated in the outflow direction from the interior to the borehole.

29. The apparatus of claim 24, further comprising a second filter disposed adjacent the at least one first orifice and bridging off with particulate in the fluid flow communicated in the outflow direction from the interior to the borehole.

30. The apparatus of claim 24, wherein the at least one first outflow valve bridges off with particulate in the fluid flow communicated in the outflow direction from the interior to the borehole.

* * * * *